United States Patent [19]

Araya et al.

[11] Patent Number: 4,524,418

[45] Date of Patent: Jun. 18, 1985

[54] DEMAND ESTIMATION APPARATUS

[75] Inventors: Shinji Araya, Takarazuka; Shintaro Tsuji, Nagoya, both of Japan

[73] Assignee: Mitsubishi Denki Kabushiki Kaisha, Tokyo, Japan

[21] Appl. No.: 522,696

[22] Filed: Aug. 12, 1983

[30] Foreign Application Priority Data

Aug. 24, 1982 [JP] Japan ..... 57-146512

[51] Int. Cl.[3] ..... B66B 1/20

[52] U.S. Cl. ..... 364/436; 187/29 R

[58] Field of Search ..... 364/436; 187/29 R

[56] References Cited

U.S. PATENT DOCUMENTS

| | | | |
|---|---|---|---|
| 4,030,571 | 6/1977 | Kaneko et al. | 187/29 R |
| 4,030,572 | 6/1977 | Kaneko et al. | 187/29 R |
| 4,044,860 | 9/1977 | Kaneko et al. | 187/29 R |
| 4,081,059 | 3/1978 | Kuzunuki et al. | 187/29 R |
| 4,355,705 | 10/1982 | Schröder et al. | 187/29 R |
| 4,411,337 | 10/1983 | Schröder et al. | 187/29 R |
| 4,458,787 | 7/1984 | Uetani | 187/29 R |

*Primary Examiner*—Gary Chin

*Attorney, Agent, or Firm*—Leydig, Voit, Osann Mayer and Holt, Ltd.

[57] ABSTRACT

A demand estimation apparatus for controlling machines according to revised estimated demand values wherein estimated demand values are calculated by dividing demand cycles which are fluctuating similarly cyclically into a plurality of sections (time zones), an adjusting section is interposed between each two sections adjoining each other, and an estimate of the fluctuation of the demand is determined based on measurements of both the demand value of the adjusting section and the demand values of the two adjoining sections, and wherein the estimated demand value of each adjusting section is compared with the estimated demand values of the respective two adjoining sections and, based on the comparison, each adjusting section is moved as a whole toward one of the adjoining sections by a predetermined time width when the estimated demand value of the adjusting section more closely approximates the estimated demand value of that one of the adjoining section than the other adjoining section, thus modifying the time widths of both adjoining sections, and the estimated demand value is revised to account to for fluctuations in the demand within the shifted adjusting section and modified adjoining sections.

10 Claims, 11 Drawing Figures

DEMAND ESTIMATION APPARATUS

BACKGROUND OF THE INVENTION

This invention relates to improvements in a demand estimation apparatus for estimating a demand which fluctuates depending upon time zones, such as the traffic volume of elevators in a building and the electric power load of a power station.

The traffic volume of elevators in a building, the electric power load of a power station, or the like (hereinbelow, termed "demand") fluctuate irregularly when closely observed within a period of one day, but present similar aspects for the same time zones when observed over several days. In, for example, an office building, elevator passengers on their way to their office floors crowd on the first floor during a short period of time in the time zone in which they attend offices in the morning. In the first half of the lunch hour, many passengers go from the office floors to a restaurant floor, while in the latter half thereof, many passengers go from the restaurant floor and the first floor to the office floors. In addition, many passengers go from the office floors to the first floor in the time zone in which they leave the offices in the evening. The volume of traffic in the up direction and in the down direction are nearly equal in the daytime time zones other than mentioned above, while the volume of traffic becomes very small throughout the nighttime.

In order to deal with the traffic in the building changing in this manner by means of a limited number of elevators, the elevators are usually operated under group supervision. One of the important roles of the group supervision of the elevators is to assign an appropriate elevator to each hall call registered. Various assignment systems for the hall calls have been proposed. By way of example, there has been considered a system wherein, when a hall call is registered anew, it is tentatively assigned to respective elevators, and the waiting times of all hall calls, the possibility of the full capacity of passengers, etc. are predicted to calculate service evaluation values for all the cases, from among which the appropriate elevator is selected. In order to execute such predicative calculations, traffic data peculiar to each respective building is required. For example, data on the number of passengers who get on and off the cage of each elevator at intermediate floors are required for predicting the possibility of the full capacity. When such traffic data which changes every moment is stored each time, an enormous memory capacity is necessitated, which is not practical. Usually, the required memory size is reduced by dividing the operating period of time in one day into several time zones, wherein only the average traffic volumes of the respective time zones are stored. After the completion of the building, however, there is a possibility that traffic data will change in accordance with changes in personnel organization in the building, and hence, it is difficult to obtain good traffic data with which the demand can be predicated accurately. For this reason, there has been thought out a system wherein traffic conditions in the building are continuously detected so as to sequentially improve traffic data.

More specifically, the operating period of time in one day is divided into K time zones (hereinbelow, termed "sections"), and a time (hereinbelow, termed "boundary") by which a section k−1 and section k are bounded is denoted by $t_k$ (k=2, 3, ...K). Times $t_1$ and $t_{K+1}$ are the starting time and end time of the elevator operation, respectively. The average traffic volume $P_k$ (l) of the section k on the l-th day is supposed to be given by the following equation (1):

$$P_k(l) = \frac{1}{t_{K+1} - t_K} \begin{pmatrix} X_k^u(l) \\ X_k^d(l) \\ Y_k^u(l) \\ Y_k^d(l) \end{pmatrix} \tag{1}$$

Here, $X_k^u$ (l) is a column vector of F−1 dimensions (where F denotes the number of floors) the elements of which are the number of passengers to get on cages in the up direction at respective floors in the time zone k of the l-th day. Similarly, $X_k^d$ (l), $Y_k^u$ (l) and $Y_k^d$ (l) are column vectors which indicate the number of passengers to get on the cages in the down direction, the number of passengers to get off the cages in the up direction and the number of passengers to get off the cages in the down direction, respectively. (where the letters X and Y represents the number of people getting on and off the elevator, respectively, and u and d represent the upward and downward direction of the elevator, respectively.) The average traffic volume (hereinbelow, termed "average demand") $P_k$ (l) is measured by a passenger-number detector which utilizes load changes during the stoppage of the cages of the elevators and/or industrial television, ultrasonic wave, or the like.

First, it will be considered to sequentially correct the representative value of the average demand $P_k$ (l) of each time zone in a case where the boundary $t_k$ which is the time zone demarcating time is fixed.

It is thought that the columns {$P_k$ (1), $P_k$ (2), ...} of the average demands occuring daily will disperse in the vicinity of a certain representative value $P_k$. Since the magnitude of the representative value $P_k$ is unknown, it needs to be estimated by any method. In this case, there is the possibility that the magnitude itself of the representative value $P_k$ will change. The representative value is therefore predicated by taking a linear weighted average given in Equations (2) and (3) below and attaching more importance to the average demand $P_k$ (l) measured latest, than to the other average demands $P_k$ (1), $P_k$ (2), ... and $P_k$ (l−1).

$$\hat{P}_k(l) = (1 - a)^l P_k(O) + \sum_{i=1}^{l} \lambda_i P_k(i) \tag{2}$$

$$\lambda_i = a(1 - a)^{l-i}$$

Here, $\hat{P}_k$ (l) the representative value which has been predicated from the average demands $P_k$ (1), ... and $P_k$ (l) measured till the l-th day, and $P_k$ (o) is an initial value which is set to a suitable value and is set in advance. $\lambda_i$ denotes the weight of the average demand $P_k$ (i) measured on the i-th day, and this weight changes depending upon a parameter a. More specifically, an increase in the value of the parameter a results in an estimation in which more importance is attached to the latest measured average demand $P_k$ (l) than to the other average demands $P_k$ (1), ..... and $P_k$ (l−1), and in which the predictive representative value $\hat{P}_k$ (l) quickly follows up the change of the representative value $P_k$. However, when the value of the paramer a is too large, it is feared that the predictive representative value will change too violently in a manner to be influenced by the random variations of daily data. Meanwhile, Equations (2) and (3) can be rewritten as follows:

$$\hat{P}_k(l)=(1-a)\,\hat{P}_k(l-1)+a\,P_k(l) \quad (4)$$

$$\hat{P}_k(o)=P_k(o) \quad (5)$$

In accordance with the above equation (4), there is the advantage that the weighted average of Equation (2) can be calculated without storing the observation values $P_k(i)$ $(i=1, 2, ..., l-1)$ of the average demands in the past.

However, granted that the foregoing representative value $P_k$ $(k=2, 3, ..., K)$ of the average demand of each time zone has been precisely estimated, the deviation thereof from the actual demand is feared to become large near the demarcating boundary $t_k$ $(k=2, 3, ..., K)$ when the boundary $t_k$ itself is inappropriate. This large deviation brings about the diasdvantage that the predictive calculations of the waiting times, the possibility of the full capacity, etc. become erroneous, so the elevators are not group-supervised as intended.

An apparatus for solving this disadvantage has been proposed in Japanese patent application No. 57-111165.

The apparatus will be outlined with reference to FIG. 1. One cycle of a demand fluctuating similarly cyclically is divided into a plurality of sections so as to estimate the demand for each section. Further, an adjusting section $(t_k-\Delta t \longleftrightarrow t_k+\Delta t)$ is set in the vicinity of the boundary $t_k$ between the two sections $k-1$ and k adjoining each other, and the estimation value $q_k(l)$ of the demand in the adjusting section is compared with the respective estimation values $p_k-1$ (l) and $p_k(l)$ of the two sections, so as to move the boundary $t_k$ in the direction in which the section $k-1$ or k having the closer estimation to the estimation value $q_k(l)$ of the adjusting section is broadened a predetermined width. According to this technicue, the demand in the vicinity of the boundary is estimated with the estimation value of the broadened section, and it can be estimated with high precision.

However, in case of, e.g., operating elevators under group supervision on the basis of the estimation value thus obtained, estimation values for use in the group-supervised operation are $\hat{P}_{k-1}(l)$ and $\hat{P}_k(l)$, and they shift from $\hat{P}_{k-1}(l)$ to $\hat{P}_k(l)$ at $t_k$ in a step.

As seen from the demand curve in FIG. 1, the demand does not suddenly increase or decrease at a certain point in time, but it usually linearly increases or decreases along a given curve. With the aforementioned technique, the estimation value $\hat{P}_{k-1}(l)$ and/or $\hat{P}_k(l)$ is used for the transient period of the increase and decrease. It has therefore been feared that the difference between the estimated demand and the actual demand will become too great to properly perform the group-supervised operation in accordance with the actual situation.

SUMMARY OF THE INVENTION

This invention eliminates the disadvantage as described above, and consists in a demand estimation apparatus wherein one demand cycle fluctuating similarly cyclically is divided into a plurality of sections (time zones) so as to estimate the demand for each section, characterized in that an adjusting section (adjusting time zone) is interposed between each two sections (time zones) in said plurality of sections adjoining each other, so as to estimate the fluctuation of the demand by using both the demand estimation value of the adjusting sections (adjusting time zones) and the demand estimation values of the respective two adjoining sections (time zones), and wherein the demand estimation value of each adjusting section (adjusting time zone) is compared with the estimation values of the respective two adjoining sections (time zones), so as to move each adjusting section (adjusting time zone) to the side of one of the respective adjoining sections (time zones) by a predetermined amount when the demand estimation value of the adjusting section (adjusting time zone) more closely approximates the demand estimation value of said one of the respective adjoining sections (time zone) than the other respective adjoining section (time zone) in said adjoning sections.

DETAILED DESCRIPTION OF THE INVENTION

Figure 1:
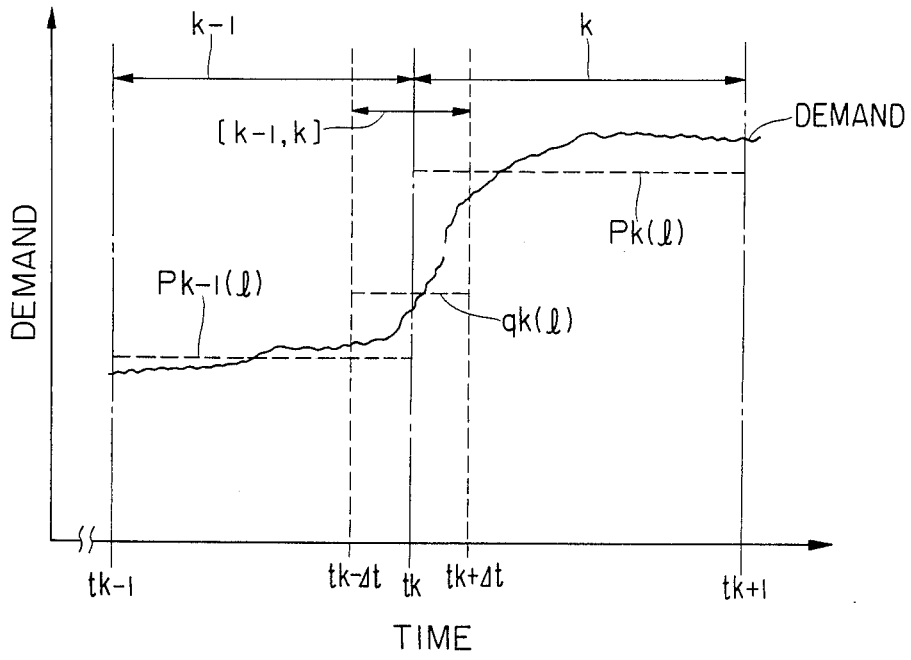
FIG. 1 PRIOR ART
FIG. 1 is a diagram showing fluctuations in demand and divided time zones in order to outline a prior art.
Figure 2:
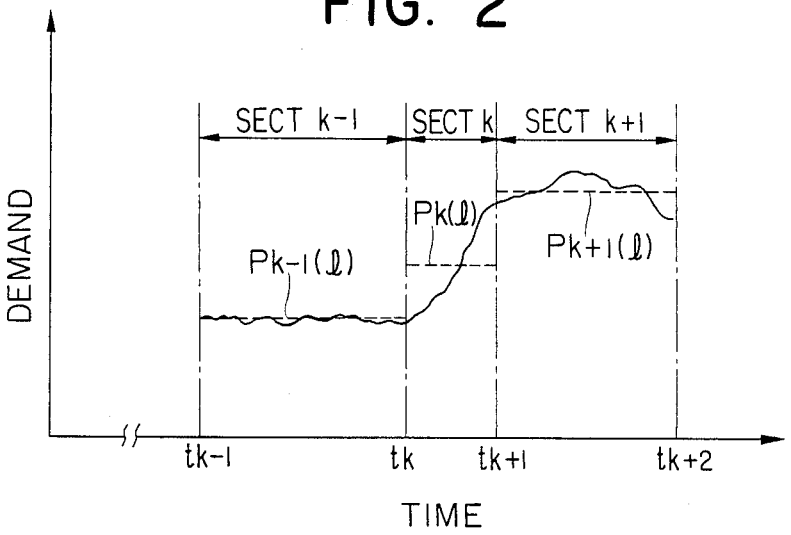
FIG. 2 is a diagram showing fluctuations in demand and divided time zones similar to FIG. 1, in order to outline this invention.
Figure 3:
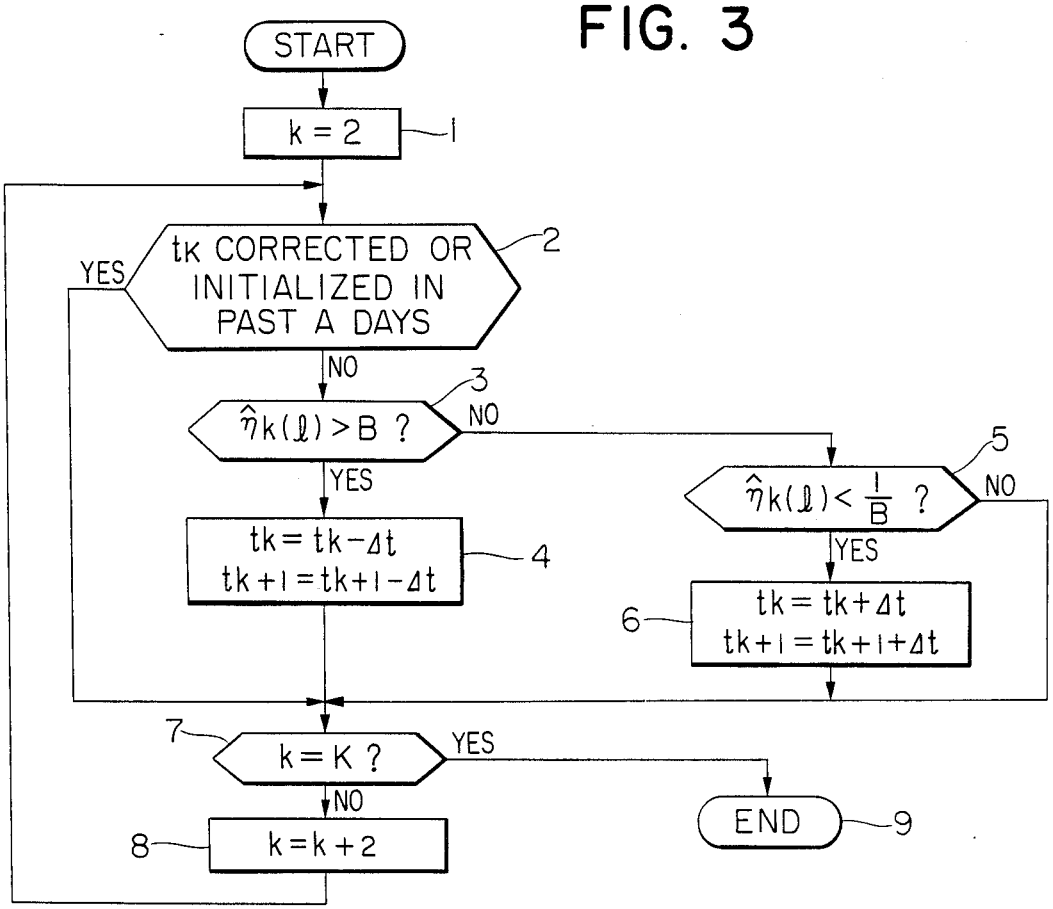
FIG. 3 is a flowchart showing a process for correcting the position of an adjusting section.

Referring to FIGS. 2 and 3, there will be first described the outline of a procedure for setting an appropriate boundary between respectively adjacent sections in a demand estimation apparatus according to this invention.

FIG. 2 is a diagram showing the relationship of the sections and an adjusting section in the case where a demand is expressed in one dimension. Between the section $k-1$ and the section $k+1$, there is provided the adjusting section k whose time width is smaller than those of the sections $k-1$ and $k+1$. The respective sections $k-1$, k and $k+1$ have the observation data $P_{k-1}(l)$, $P_k(l)$ and $P_{k+1}(l)$ of their average demands.

FIG. 3 shows a procedure for setting the optimum boundaries of each section according to this invention. The adjustment of the boundary is made using a unit time width $\Delta t$ which is smaller than the time width of the adjusting section. In the decision, the following charactor is introduced:

$$\hat{\eta}_k(l) = (1-b)\,\hat{\eta}_k(l-1) + b\,\eta_k(l) \quad (6)$$

-continued $$\eta_k(l) = \frac{\| P_{k-1}(l) - q_k(l) \|^2}{\| P_k(l) - q_k(l) \|^2} \quad (7)$$

Here, || || denotes absolute values, and b is a parameter which corresponds to the parameter a of a Equation (4).

At Step 1, the initial value of the section is set at k=2. If at Step 2, the boundaries $t_k$ and $t_{k+1}$ have been corrected (or initialized) within the past A days, the control flow proceeds to Step 7 without correcting the boundaries $t_k$ and $t_{k+1}$. Otherwise, the control flow proceeds to Step 3, in which a decision based on the charactor $\hat{\eta}_k$ (l) is made. More specifically, when the charactor $\hat{\eta}_k$ (l) is greater than a constant value B, this denotes that the estimation value $\hat{P}_k$ (l) of the average demand of the adjusting section k is closer to the estimation value $\hat{P}_{k+1}$ (l) of the average demand of the section k+1 than to the estimation value $\hat{P}_{k-1}$ (l) of the average demand of the section k−1, in excess of a reference determined by a constant value B. Therefore, the control flow proceeds to Step 4, in which the boundaries $t_k$ and $t_{k+1}$ are corrected so as to shift the adjusting section k toward the section k−1 by the unit time Δt. When, at Step 5, the charactor $\hat{\eta}_k$ (l) is smaller than a constant value 1/B, which denotes that the estimation value $\hat{P}_k$ (l) of the average demand of the adjusting section is closer to the estimation value $\hat{P}_{k-1}$ (l) of the average demand of the section k−1 than to the estimation value $\hat{P}_{k+1}$ (l) of the average demand of the section k+1, the control flow proceeds to Step 6, in which the boundaries $t_k$ and $t_{k+1}$ are corrected so as to shift the adjusting section k toward the section k+1 by the unit time Δt. In addition, when the charactor $\eta_k$ (l) lies between the constant values B and 1/B, the boundaries $t_k$ and $t_{k+1}$ are decided to be appropriately set, and they are not corrected. At Step 7, it is decided whether or not the corrections have ended for all the boundaries $t_k$ (k=2, 3, ... K). If they have not ended, the value of the section k is increased by 2 (two) at Step 8, and the control flow returns to Step 2, whereupon the processing described above is repeated. In this manner, Steps 2–8 are repeated until k=K is established.

Here, the unit time Δt, the number of days A and the constant value B govern the characteristics of the above procedure. The number of days A is the number of days which are required for the convergence of the charactor $\eta_k$ (l) to be determined by b, and during which the boundaries are not corrected. As the constant value B is made smaller, a finer correction is made. However, when it is too small with respect to the unit time Δt, hunting may arise.

The above procedure uses the estimation value $P_k$ (l) (k=2, 4, ..... K) of the average demand of the adjusting section, not only for the decision for correcting the boundaries $t_k$ and $t_{k+1}$, but also as information for the control of elevators or the like by supposing that the adjusting section is also one section. Accordingly, the error between an actual demand and a demand estimation value in the transient period during which a demand changes greatly becomes small, and an estimation value conforming with actual conditions can be obtained.

A practicable embodiment will now be described with reference to FIGS. 4 to 11.

This embodiment will be described as to a case where traffic volumes in the up and down directions for elevators within a building are estimated in each of three adjoining time zones. Needless to say, however, the invention is also applicable to a case of estimating traffic volumes in floor unit or a case of estimating traffic volumes in four or more time zones.

Figure 4:
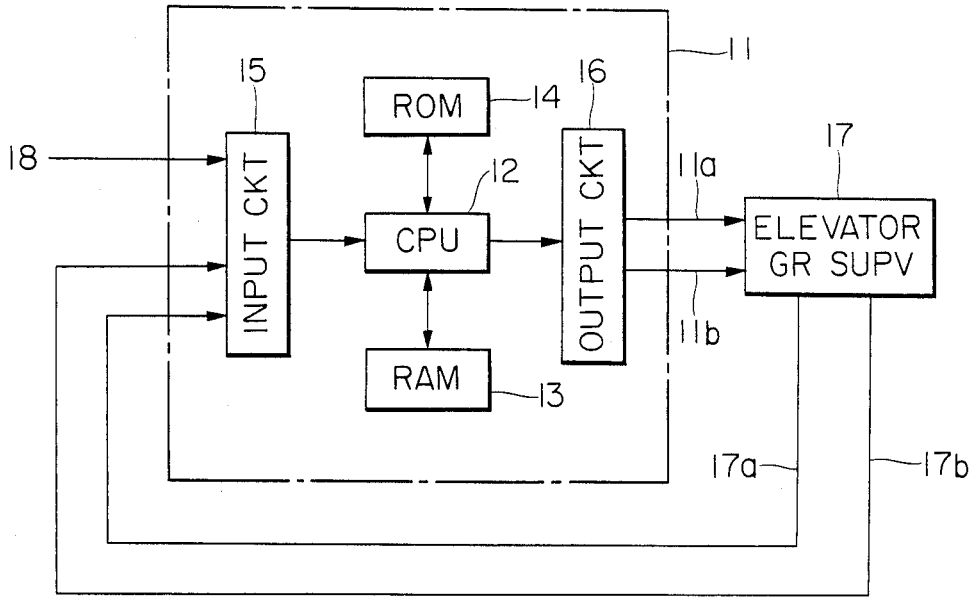
FIG. 4 is a block diagram showing a group supervision system for elevators to which this invention is applied.

In FIG. 4, a demand estimation apparatus 11 is constructed of an electronic computer such as a microcomputer, which calculates and delivers the estimation value 11*a* of an up traffic volume and the estimation value 11*b* of a down traffic volume in each time zone. This demand estimation apparatus 11 comprises a central processing unit 12 (hereinbelow, termed "CPU"), a read only memory 14 (hereinbelow, termed "ROM") which stores programs and constant value data, an input circuit 15 which forms converter for receiving input signals into the CPU 12, and an output circuit 16 which forms a converter for delivering the signals from the CPU 12. A group supervision system 17 calculates the degree of service on the basis of the estimation value 11*a* of the up traffic volume and the estimation value 11*b* of the down traffic volume, and allots hall calls to cages. It is a conventional type of apparatus.

A number-of-up-passengers signal 17*a* and a number-of-down-passengers signal 17*b* indicate respective values obtained in such a way that the numbers of passengers having gotten on each cage in the up direction and down direction are detected by a weighing device, disposed in a cage floor, every unit time (e. g., 1 second) (for example, one person is calculated as being 65 kg heavy) and that they are totaled for all the cages. A clock pulse 18 is issued from a timepiece (not shown) every unit time Δt (=5 minutes).

Figure 5:
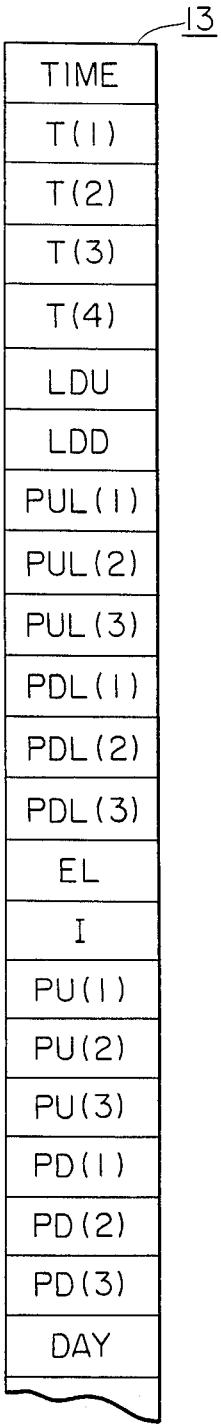
FIGS. 5 and 6 are arrayal diagrams of memories for use in this invention.

FIG. 5 shows the information stored in a random access memory (RAN) 13 which also constitutes the apparatus 11. TIME designates time data representative of the clock signal 13. T(1) designates boundary time data representative of the starting time of a time zone (section) I, T(2) boundary time data representative of the boundary between the time zone I and an adjusting time zone (section) II, T(3) boundary time data representative of the boundary between the adjusting time zone (section) II and a time zone (section) III, and T(4) boundary time data representative of the end time of the time zone III. LDU and LDD are number-of-up-passengers data and number-of-down-passengers data which represent the number-of-up-passengers signal 17*a* and the number-of-down-passengers signal 17*b*, respectively. PU(1)–PU(3) are average up traffic volume data which represent the average values of the up traffic volumes observed in the time zones I–III, respectively, while PD(1)–PD(3) are average down traffic volume data which represent the average values of the down traffic volumes observed in the time zones I–III, respectively. These data PU(1)–PU(3) and PD(1)–PD(3) correspond to $P_k$ (l) in Equation (1). PUL(1)–PUL(3) are the estimation value data of the average down traffic volumes of the time zones I–III, respectively, while PDL(1)–PDL(3) are the estimation value data of the average down traffic volumes of the time zones I–III, respectively. These data PUL(1)–PUL(3) and PDL(1)–PDL(3) corresponds to $\hat{P}_k$(l) in Equation (4). EL indicates charactor data representative of a charactor for deciding which of the adjoining time zones the adjusting time zone II is more similar to. The charactor EL corresponds to $\hat{\eta}_k$ (l) in Equation (6). DAY indicates number-of-elapsed days data expressive of the number of days elapsed after the boundary time data T(2) and T(3) have been initialized or corrected. Shown at I is a counter which is used as a variable expressive of the time zones.

Figure 6:
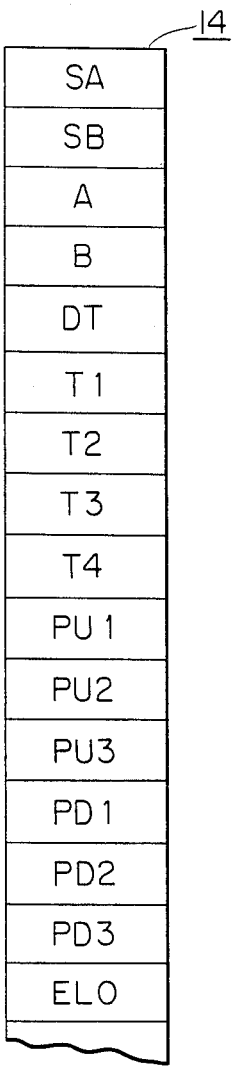

FIG. 6 shows the information stored in the ROM 14. SA and SB are constant value data which are set at 1/6 and 1/6 and which correspond to the parameter a in Equation (4) and the parameter b in Equation (6), respectively. Constant value data A is set at 10 days and corresponds to the number of days for decision A in FIG. 3, while constant value data B is set at 3 and corresponds to the parameter B in FIG. 2. Constant value data DT is set at 1 (=5 minutes), and corresponds to Δt in FIG. 2 or FIG. 3. T1–T4 indicate the initial values of the boundary time data T(1)–T(4), and are set at, for example, 87 (=7:15), 100 (=8:20), 102 (=8:30) and 110 (=9:10), respectively. Likewise, PU1–PU3, PD1–PD3 and ELO indicate the initial values of the estimation value data PUL(1)–PUL(3) of the average up traffic volumes, the estimation value data PDL(1)–PDL(3) of the average down traffic volumes and the charactor data EL, respectively. They are set at, for example, 65 (passengers/5 minutes), 109 (passengers/5 minutes), 130 (passengers/5 minutes), 5 (passengers/5 minutes), 7 (passengers/5 minutes), 20 (passengers/5 minutes) and 1.0, respectively.

Figure 7:
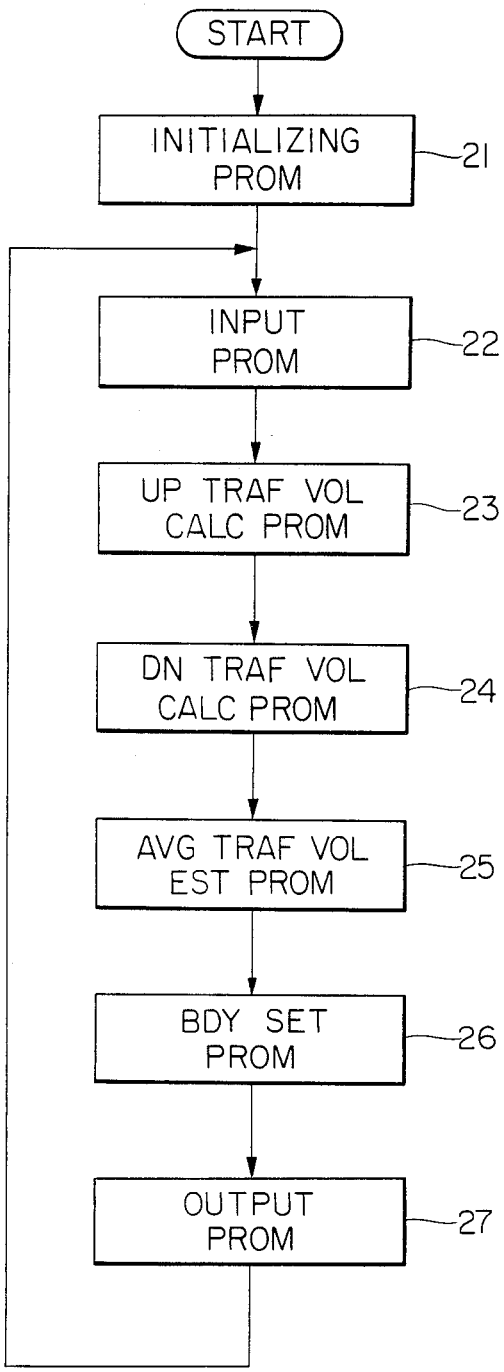
FIG. 7 is a general flow diagram of programs for executing this invention.

In FIG. 7, numeral 2 designates an initializing program for setting the initial values of various data. An input program 22 accepts signals from the input circuit 15 and sets them in the RAM 1. An up traffic volume calculating program 2 calculates the average values of the up traffic volumes observed in the respective time zones, while a down traffic volume calculating program 2 calculates the average values of the down traffic volumes similarly to the above. An average traffic volume estimating program 2 calculates the estimation values of the average traffic volumes in the respective time zones. A boundary setting program 2 corrects the boundary times of the respective time zones. An output program 2 transmits the estimated average traffic volume data through the output circuit 16. These programs are stored in the ROM 14.

In FIGS. 8 to 11, numerals 31–33 indicate the operating steps of the initializing program 21, numerals 41–49 the operating steps of the up traffic volume calculating program 23, numerals 51–56 the operating steps of the average traffic volume estimating program 25, and numerals 61–68 the operating steps of the boundary setting program 26.

The operations of this embodiment will now be described.

Figure 8:
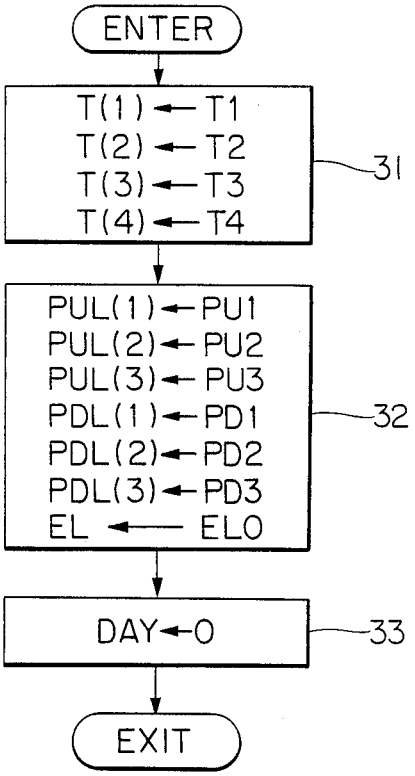
FIG. 8 is a diagram showing the operating procedure of an initializing program.
Figure 9:
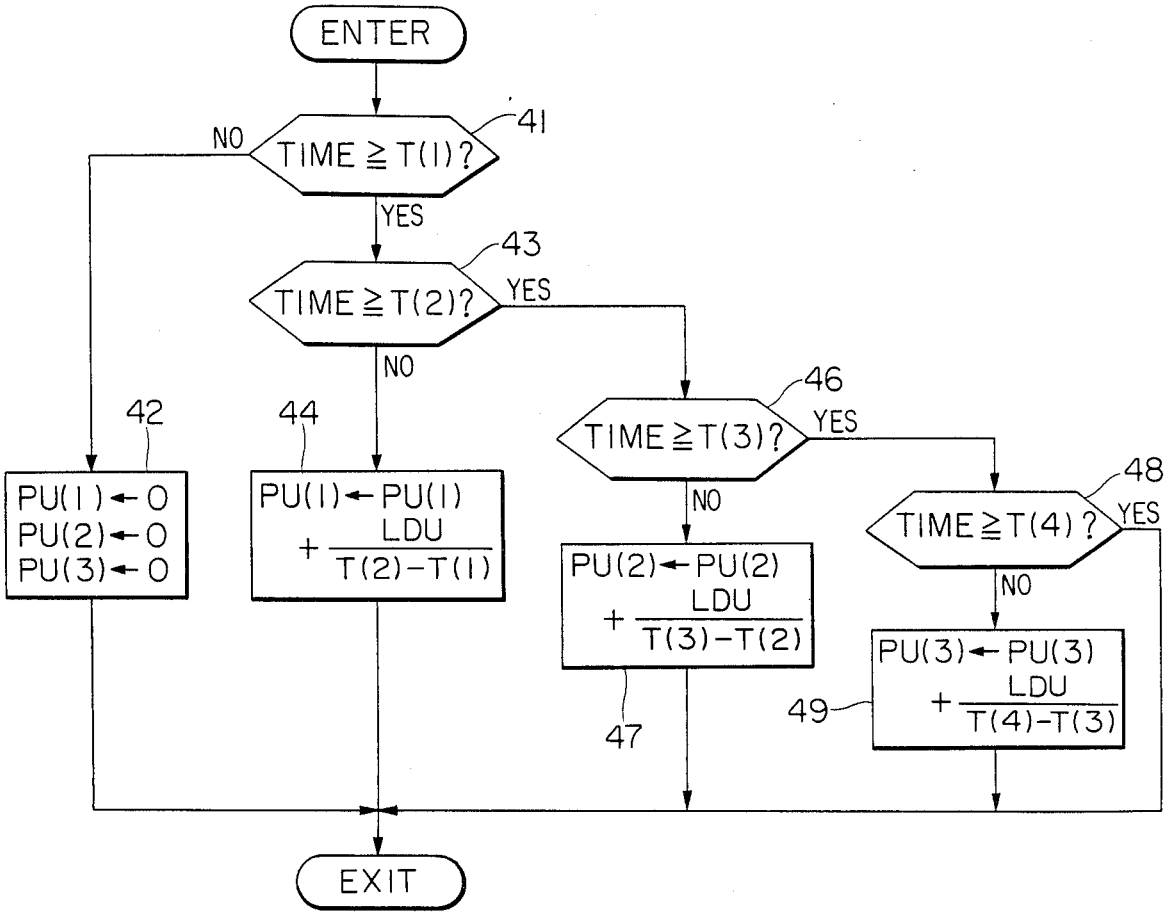
FIG. 9 is a diagram showing the operating procedure of an up traffic volume calculating program.
Figure 10:
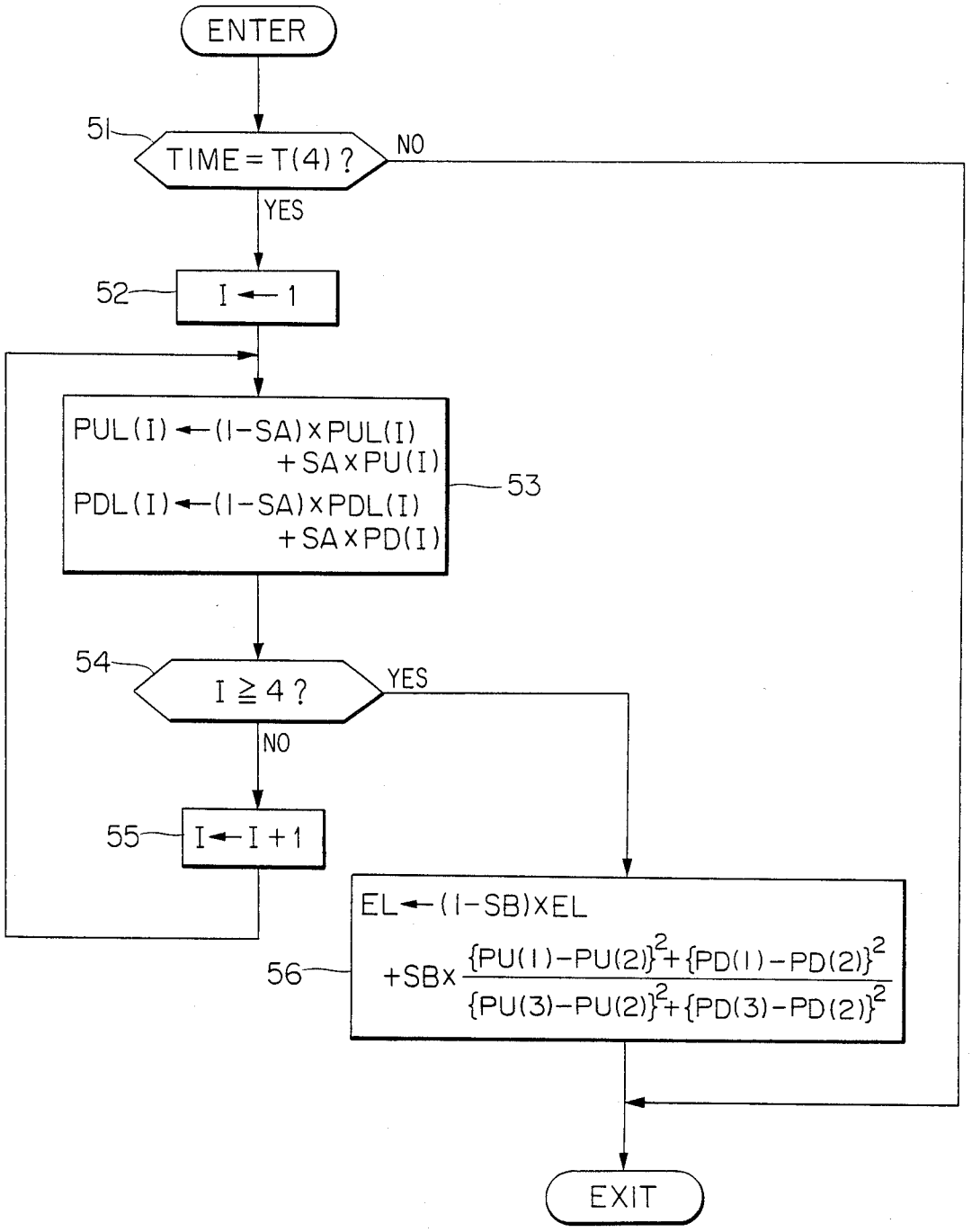
FIG. 10 is a diagram showing the operating procedure of an average traffic volume estimating program.
Figure 11:
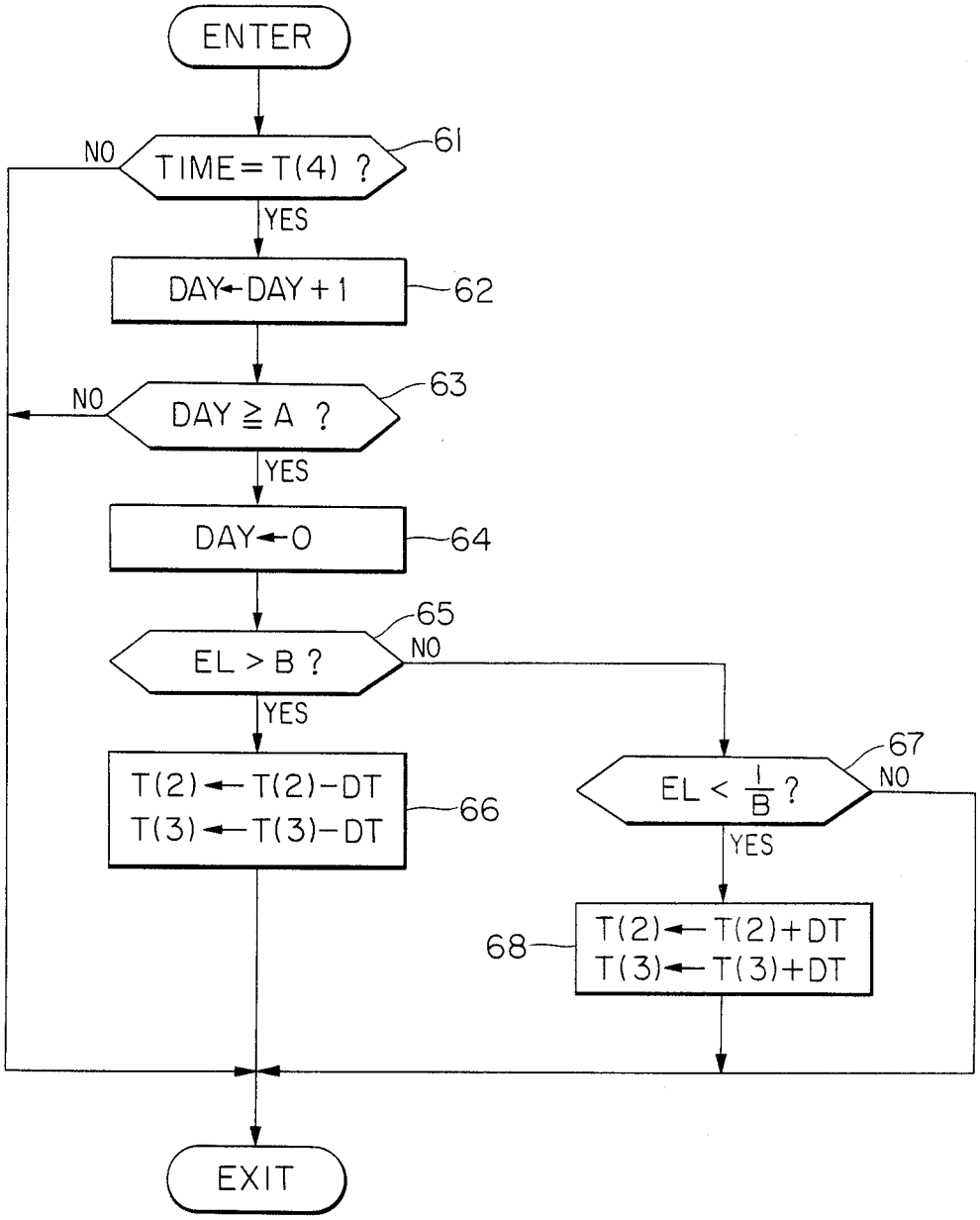
FIG. 11 is a diagram showing the operating procedure of a boundary setting program.

When the power source of the demand estimation apparatus 11 is turned "on", the initializing program 21 is first executed by the operating steps shown in FIG. 8 and is followed by the programs 22–27. The programs are run at a rate of one time per second.

A. Operations of Initializing Program 21:

At Step 31, the boundary times T(1)–T(4) are respectively initialized to constant value data T1–T4. At Step 32, the estimation value data PUL(1)–PUL(3) and PDL(1)–PDL(3) are respectively initialized to the constant value data PU1–PU3 and PD1–PD3, and the charactor data EL is initialized to the constant value data ELO. At the next step 33, the number-of-elapsed-days data DAY is initialized to 0.

B. Operations of Input Program 22:

Since the input program 22 merely feeds input signals from the input circuit 15 into the RAM 13, it will not be described in detail. By way of example, when the timepiece indicates 8 o'clock, the clock signal 18 is "96", it is accepted through the input circuit 15, and the time data TIME is set at "96" in the RAM 13. The number-of-passengers data LUD and LDD are similarly set.

C. Operations of Up Traffic Volume Calculating Program 23:

At Step 41, it is decided if the time zone to have its average traffic volume calculated has been reached. When the time data TIME is smaller than the boundary time T(1), the control flow proceeds to Step 42, in which all the average up traffic volume data PU(1)–PU(3) are set at 0 as the initialization for calculating the average traffic volumes. When, at Step 41, the time data TIME becomes at least equal to the boundary time T(1), the control flow proceeds to Step (43). When the time data TIME is smaller than the boundary time T(2) here, the control flow proceeds to Step 44. Here, using the number-of-passengers data LDU observed anew, the average up traffic volume data PU(1) of the time zone I is corrected so as to increase by the up traffic volume per unit time, LDU/ T(2)–T(1).

When the time data TIME is $T(2) \leqq TIME < T(3)$, the steps proceed along 43→46→47. Here, using the average of the adjusting time zone II, the traffic volume data TU(2) is corrected in the same manner as in Step 44.

Further, when the time data TIME is $T(3) \leqq TIME < T(4)$, the steps proceed along 46→48→49. Here, the average up traffic volume data PU(3) of the time zone III is corrected in the same manner as in Step 44.

In this way, the average up traffic volume data PU(1)–PU(3) of the time zones I–III are sequentially corrected in the up traffic volume calculating program 23.

D. Operations of Down Traffic Volume Claculating Program 24:

Since the program 24 is a program which sequentially corrects the average down traffic volume data PD(1)–PD(3) of the time zones I–III likewise to the up traffic volume calculating program 23, a detailed description therefor shall be omitted.

E. Operations of the Average Traffic Volume Estimating Program 25:

Only when the time data TIME coincides with the end time T(4) of the time zone III, the following steps 52–56 are executed. At this time, the control flow proceeds from Step 51 to Step 52, in which the counter I is initialized to "1". At Step 53, a value obtained by multiplying the estimation value data PUL(I) of the average up traffic volume calculated by the last day, by (1−SA) and a value obtained by multiplying the average up traffic volume data PU(I) observed just on the particular day, by SA are added to set the estimation value data PUL(I) of the average up traffic volume anew. Likewise, the estimation value data PDL(I) of the average down traffic volume is set again. While the counter I is being incremented by 1 at a time at Step 55, Steps 53–55 are repeated until I=4 is eatablished at Step 54 and the estimation values of the average traffic volumes in the time zones I–III are all calculated, whereupon the control flow proceeds to Step 56.

Next, the charactor data EL is calculated at Step 56. This step 56 sets new charactor data EL by adding up a value obtained by multiplying the charactor data EL calculated by the last day, by (1−SB) and a value obtained by multiplying the value of a similar charactor found using the average traffic volume data PU(1)–PU(3) and PD(1)–PD(3) observed just on the particular day, by SB.

In this way, the average traffic volume calculating program 25 corrects the estimation value data PUL(-

1)-PUL(3) and PDL(1)-PDL(3) of the average traffic volumes in the respective time zones every day, and it also compensates the charactor data EL required for correcting the boundary times T(2) and T(3).

F. Operations of Boundary Setting Program 26:

Only when the time data TIME coincides with the end time T(4) of the time zone III, the following steps 62–68 are executed. At this time, Step 61 proceeds to Step 62, in which the number-of-elapsed-days data DAY is increased by 1 (one). Step 63 compares the number-of-elapsed-days data DAY with the deciding number-of-days data A (=10 days). If DAY<A holds, the calculation of the boundary setting program 26 is terminated without correcting the boundary times T(2) and T(3). If, at Step 63, the number-of-elapsed-days data DAY is 10, the control flow proceeds to Step 64, in which this data DAY is reset to 0. Assuming that the charactor data EL has been calculated as 10 by the average traffic volume estimating program 25, EL=10>B (=3) holds at Step 65, so that the control flow proceeds to Step 65. Here, the boundary time T(2) between the time zones I and II (assumed to have an initialized value 100) has only DT subtracted, and 100−1=99 is set anew. Likewise, the boundary time T(3) between the time zones II and III (assumed to have an initialized value 102) is set at 102−1=101 anew. If the charactor data is EL=0.1, EL<1/B holds. In this case, the steps proceed along 65−67−68, and the boundary times T(2) and T(3) have DT added and are respectively set at 100+1=101 and 102+1=103 anew. If the charactor is EL=2, 1/B≦EL≦B holds, so that T(2) and T(3) are not corrected.

In this way, in the boundary setting program 26, the boundary times T(2) and T(3) are corrected depending upon the value of the charactor data EL.

While the constant value data DT within the unit section has been set at 5 minutes, the deciding number-of-days data A at 10 days and the parameter B at 3, they are not restrictive, but they should desirably be changed depending upon the content, nature, fluctuating magnitudes etc. of a demand to be estimated.

Needless to say, this invention is not restricted to the case of estimating the traffic volumes of elevators, but it is applicable to the estimations of various demands such as demand for electric power and demand for water.

As set forth above, in a demand estimation apparatus wherein the period of time during which similar fluctuations arise cyclically is divided into a plurality of sections so as to estimate the demand for each section, this invention provides an adjusting section between the adjoining sections and compares the estimation value of the demand in the adjusting section with the estimation values of the demand in the adjoining sections, thereby to automatically correct the adjusting section. Therefore, the demand in each section can be estimated more accurately. Especially, the deviation between the estimation value of the demand and the actual demand at the boundary of the adjoining sections can be diminished.

What is claimed is:

1. A demand estimation apparatus for controlling machines wherein a plurality of previous cycles and a present cycle of a fluctuating demand value are divided into a plurality of adjoining sections of given time width wherein the demand value in each section is measured and an stimated demand value is provided based on a measured value, said apparatus comprising:

means for dividing the present cycle of fluctuating demand value to provide adjusting sections between adjoining sections, means for measuring the demand value in each adjusting section and for providing an estimated demand value based on the measured demand value, means for comparing the estimated demand value of an adjusting section with the esimated demand values of the two sections adjoining the adjusting section to decide if the estimated demand value of the adjusting section approximates the estimated demand value of either one of the two adjoining sections in excess of a predetermined reference value, and for moving the whole adjusting section toward the other adjoining section by a predetermined time width to a shifted position with the time widths of the adjoining sections also being revised by the amount of the shift when the approximation holds, delivering means for delivering the estimated demand values of the revised adjoining sections and the shifted adjusting section as revised estimated values accounting for fluctuations in the demand, and means for controlling machines in accordance with the revised estimated values.

2. A demand estimation apparatus according to claim 1 wherein the time width of an adjusting section is set to be smaller than the time width of the adjoining sections thereto.

3. A demand estimation apparatus according to claim 2 wherein the predetermined time width by which a whole adjusting section is moved is smaller than the time width thereof.

4. A demand estimation apparatus according to claim 1 including a first memory, a second memory for storing a calculating program, and a processor operated by said calculating program for calculating the estimated demand values, said calculating program including an initializing program by which the boundary times of the sections and estimated demand values are initialized on the basis of predetermined data and then stored in said first memory.

5. A demand estimation apparatus according to claim 4 wherein the estimated demand value calculating program further includes an up traffic volume calculating program and a down traffic volume calculating program, and up-direction traffic volumes are found for the respective sections between the boundary times of the respective sections by said up traffic volume calculating program so as to calculate up traffic data on the basis of said up-direction traffic volumes, while down-direction traffic volumes are found for the respective sections between the boundary times of the respective sections by said down traffic volume calculating program so as to calculate down traffic data on the basis of said down-direction traffic volumes.

6. A demand estimation apparatus according to claim 5 wherein said estimated demand value calculating program further includes a traffic volume estimating program by which new up and down traffic volume estimated values to be used from a given time on are calculated for the respective sections on the basis of the previous up and down traffic volume estimated values and the latest up and down traffic data.

7. A control apparatus according to claim 6 wherein said traffic volume estimating program further calculates character data for deciding which of the two adjoining side sections the adjusting section is similar to.

8. A control apparatus according to claim 7 wherein said traffic volume estimating program is executed when the last section of said plurality of adjoining sections has ended.

9. A control apparatus according to claim 7 wherein said demand estimation calculating program includes a boundary setting program for determining the movement of an adjusting section on the basis of said character data.

10. A control apparatus according to claim 1 wherein said demand estimation calculating program includes a boundary setting program executed when the last section of said plurality of adjoining section has ended.

* * * * *